United States Patent [19]

Moore et al.

[11] Patent Number: 4,623,957

[45] Date of Patent: Nov. 18, 1986

[54] BATTERY POWERED AUXILIARY LIGHTING FIXTURE WITH A TIMER

[75] Inventors: Ralph F. Moore, Greenwich; Francis G. Marshall, Cheshire, both of Conn.

[73] Assignee: The Bridgeport Metal Goods Manufacturing Company, Bridgeport, Conn.

[21] Appl. No.: 662,575

[22] Filed: Oct. 19, 1984

[51] Int. Cl.[4] ..... F21L 7/00

[52] U.S. Cl. ..... 362/200; 362/191

[58] Field of Search ..... 362/200, 191, 190, 365, 362/368

[56] References Cited

U.S. PATENT DOCUMENTS

| | | | |
|---|---|---|---|
| 4,293,894 | 10/1981 | Blank | 362/191 |
| 4,409,645 | 10/1983 | Sloan | 362/200 |
| 4,414,611 | 11/1983 | Seltzer et al. | 362/200 |
| 4,442,478 | 4/1984 | Stansburg | 362/200 |
| 4,451,871 | 5/1984 | Kirkley et al. | 362/200 |

*Primary Examiner*—Magdalen Y. C. Greenlief

*Attorney, Agent, or Firm*—Cifelli, Frederick & Tully

[57] ABSTRACT

An auxiliary lighting fixture comprises a base adapted to be hung on a wall via a statistical loop fastener and receiving batteries, and a housing releasably secured on the base and having a light bulb, reflector and lens mounted thereon. The light bulb is mounted by a clip with a hook engaging the bulb's flanged base. A circuit, including a timer and control switches, is mounted to the housing and electrically connected to the batteries by contact between metal strips in both the base and housing. Upon selection of the timed mode, the bulb operates for a timer interval of 30–45 seconds, thereby preventing accidental battery depletion. ON and OFF switches are provided for untimed operation, and the OFF switch overrides the timer.

19 Claims, 7 Drawing Figures

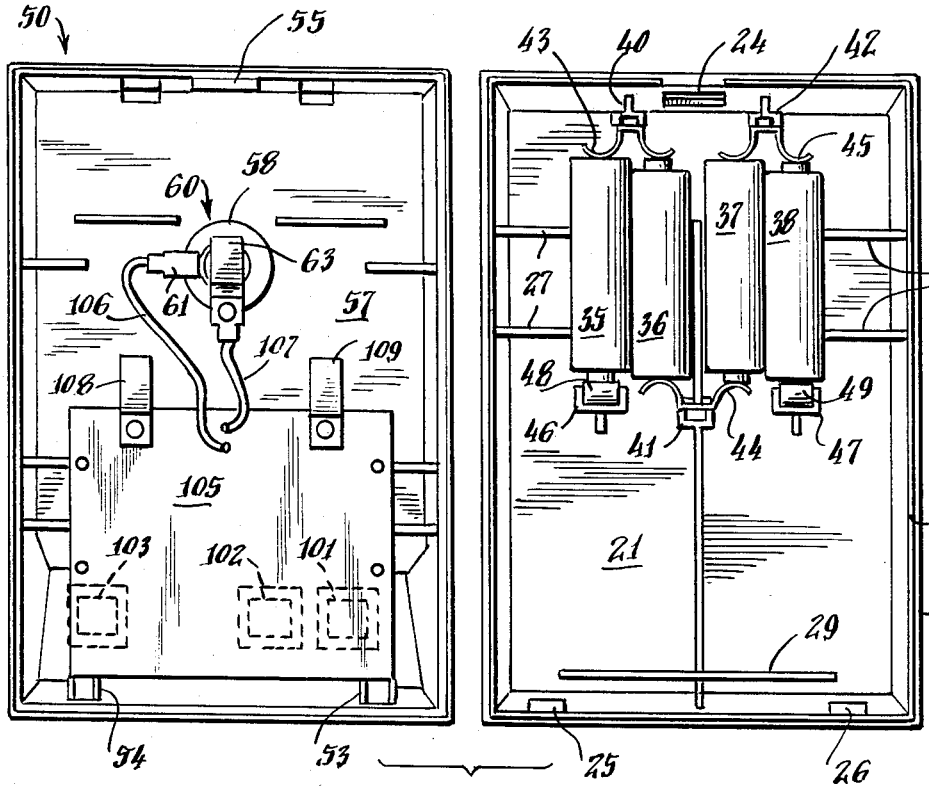
Fig. 4.
Fig. 5.
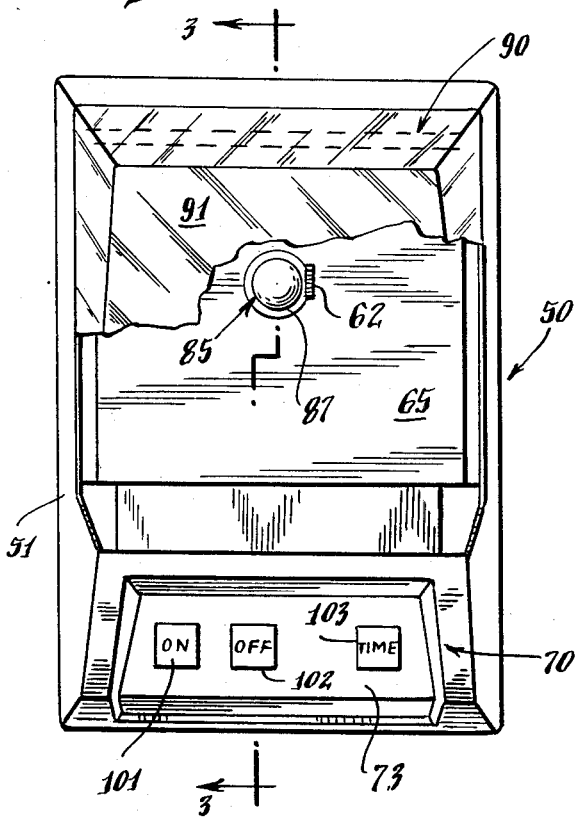
Fig. 6.
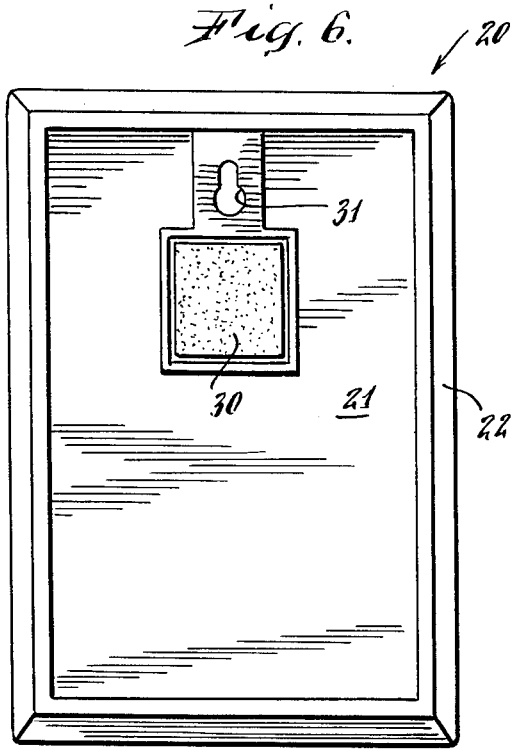

BATTERY POWERED AUXILIARY LIGHTING FIXTURE WITH A TIMER

BACKGROUND OF THE INVENTION

This invention relates to a battery powered auxiliary lighting fixture including a timing circuit for automatically turning off the light after a preset period of use.

Most lighting fixtures use AC current, and occasionally DC current, from a central power source. The lighting fixtures are connected to the central power source by wiring. It is not always practical to install such permanent lighting fixtures due to the difficulty and expense of wiring. This is often the case where the use of the lighting fixture would be occasional.

Alternate lighting sources, including portable battery powered lights, such as flashlights, lanterns and some battery powered fixtures, have been available in the art. Locations where a self-contained battery powered light source is useful and obviates the need for wiring include: in closets, cupboards and basement storage areas; in garage and outdoor storage areas; in free-standing auxiliary building such as tool sheds; and in boats. Storage areas are particularly receptive to battery powered lighting sources because the light is very helpful in locating or replacing articles, but is not needed for long periods of time which would justify installing a fixture and the wiring necessary to connect it to a central power source.

One drawback in using flashlights, lanterns or battery powered fixtures heretofore available is that such devices have simple "off" and "on" modes, and inadvertently leaving the device in the "on" mode soon depletes and renders the device unworkable at the next needed time.

SUMMARY OF THE INVENTION

According to the invention herein, there is provided a battery powered auxiliary lighting fixture characterized by efficient structure suitable for mounting on a wall or other vertical surface with good light disbursement and further characterized by inclusion of a timing circuit which automatically turns off the light after a preset period of use.

The auxiliary lighting fixture generally comprises a housing including a base adapted for mounting on a wall or other vertical surface by means of a screw received in a keyhole slot or by means of a statistical loop fastener. The base holds batteries for the auxiliary lighting fixture, including contact strips for connecting the batteries in series and presenting positive and negative terminals. The housing further includes a cover releasably secured to the base, and the cover mounts a bulb generally centrally on a planar reflector. The cover also mounts a matte-finish translucent lens which fits over the bulb and the planar reflector. The cover further mounts, on the underside thereof facing the base, a circuit board including a timing circuit, the circuit board being provided with contact strips for contacting the battery terminal contacts in order to connect the battery into the circuit. The cover also mounts button switches, including an "on" switch and "off" switch, and a timer switch, the latter initiating a timing period after which the light automatically turn off.

The timing circuit includes an RC timing which switches a transistor to control current flow through the bulb, with further provision for "on" and "off" functions independent of the timer. However, the timer switch and timer circuit, when activated while the light has been turned on by the operation of the "on" switch, will override the manual "on" function and automatically turn off the light after the preset timer interval period. A preferred timing interval is in the range of 30 to 45 seconds.

OBJECTS OF INVENTION

It is a principal object of the invention herein to provide an improved battery powered auxiliary lighting fixture.

It is an additional object of the invention herein to provide a battery powered auxiliary lighting fixture including a timing circuit for causing operation for a preset interval of time.

It is a further object of the invention herein to provide for a battery powered auxiliary lighting fixture of efficient structure which achieves good light dispersal.

These and other features and objects of the invention herein will in part be obvious and will in part appear from a perusal of the following description of the preferred embodiment and claims, taken together with the drawings.

DRAWINGS

FIG. 4 is a plan view of the base and cover of the auxiliary lighting fixture of FIG. 1, shown separated;

FIG. 5 is a front view of the auxiliary lighting fixture of FIG. 1;

FIG. 6 is a rear view of the auxiliary lighting fixture of FIG. 1; and

The same reference numerals refer to the same elements throughout the various figures.

DESCRIPTION OF PREFERRED EMBODIMENT

Figure 1:
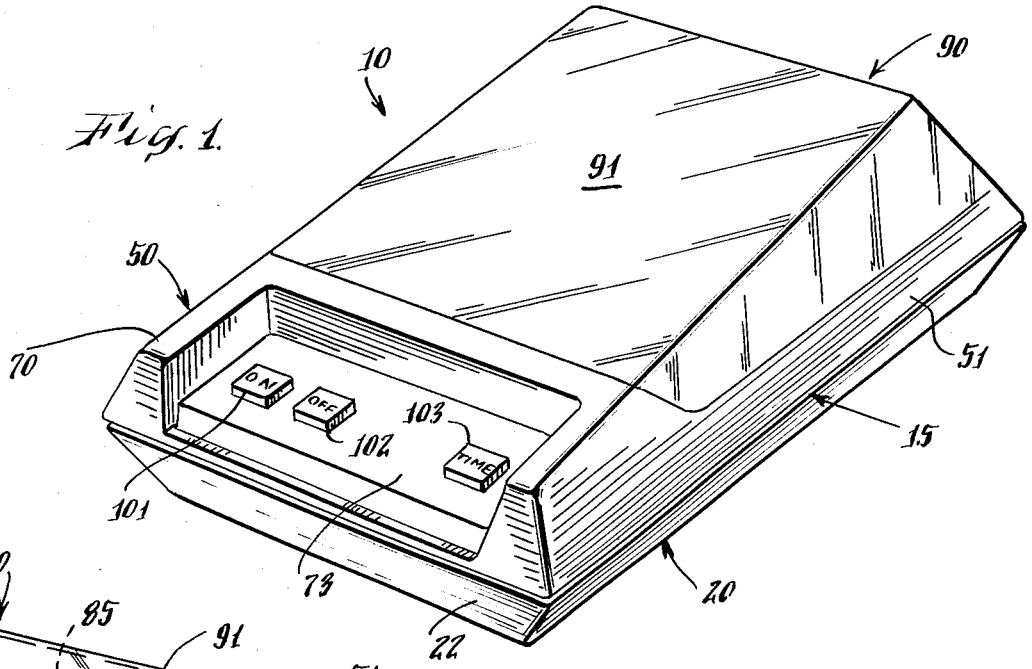
FIG. 1 is a perspective view of a battery powered auxiliary lighting fixture according to the invention herein.
Figure 2:
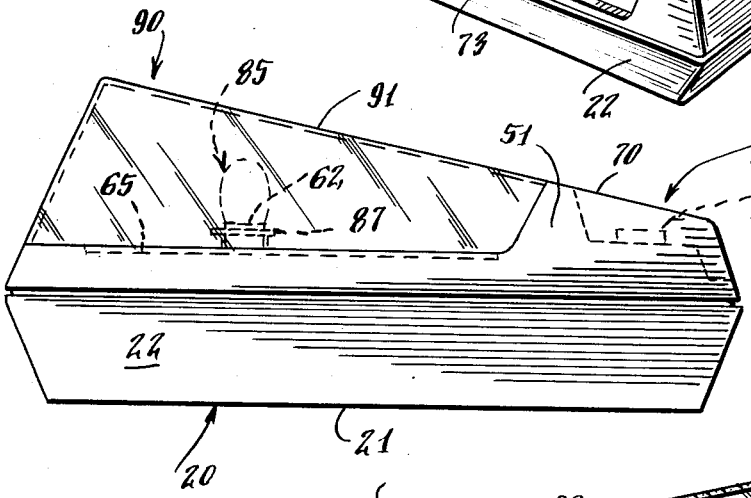
FIG. 2 is a side elevation view of the auxiliary lighting fixture of FIG. 1.

With reference to the drawings, an auxiliary lighting fixture 10 according to the invention comprises a casing 15 including a base 20 adapted for mounting the auxiliary lighting fixture on a wall or other surface and for holding batteries, and a housing 50. The housing 50 mounts a bulb 85, reflector 65 and lens 90, and circuit 100 with switches for operating the lighting fixture to provide light for a manually-controlled interval or timed interval.

The base 20 generally comprises a generally rectangular back panel 21 having a peripheral upstanding sidewall 22, which may be flared outwardly as shown in the various Figures. The upper marginal edge of the peripheral sidewall 22 preferably comprises a lip 23, best seen in FIGS. 3 and 4, for lapping with a cooperating lip in the housing 50. The peripheral sidewall 22 has an opening 24 at one end thereof and a pair of spaced apart catch ledges 25 and 26 on the opposite end thereof, for removably attaching the housing 50 to the base 20, as will be more fully discussed below.

Figure 3:
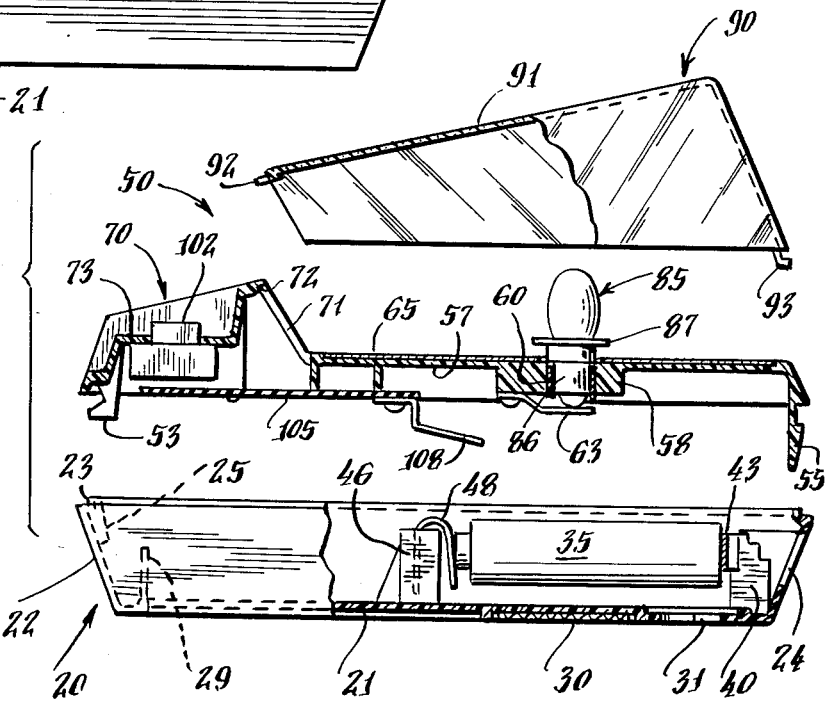
FIG. 3 is an exploded longitudinal sectional view of the auxiliary lighting fixture of FIG. 1, taken along the lines 3—3 of FIG. 5.

The back panel 21 has mounted thereto one portion 30 of statistical loop fastening material. Provided with the auxiliary lighting fixture is a second, cooperating piece of statistical loop fastening material with an adhesive backing for adhering the second piece to a wall or other surface. The auxiliary lighting fixture may then be mounted to the wall by the engagement of the two pieces of statistical loop fastening material. The back panel 21 is preferably recessed with respect to the peripheral sidewall 22, as best seen in FIGS. 3 and 6, to accommodate the statistical loop fastening material 30. The back panel 21 is also provided with an inverted keyhole slot 31 for receiving the headed end of a screw or nail as an alternate means of mounting the auxiliary lighting fixture 10 to a wall or other surface.

As best seen in FIGS. 3 and 4, the base 20 receives and holds four size AA 1.5 volt dry cells 35–38, connected in series to form a six-volt power supply for the auxiliary lighting fixture 10. Slotted posts 40, 41 and 42 upstanding from the back panel 21, respectively, hold battery contact strips 43, 44 and 45, which support the batteries longitudinally and connect the batteries in series. Ribs 27 and 28 are provided integrally with the back panel and peripheral sidewall for laterally supporting the batteries of 35–38. Posts 46 and 47, respectively, support inverted U-shaped contact strips 48 and 49, which comprise the terminals of the six-volt power supply, presented for contact connection into the circuit 100, as more fully described below.

The base 20 further comprises a rib 29 upstanding from the back panel 21 near the hooks 25 and 26, rib 29 serving as the support for the switches.

The auxiliary lighting fixture 10 further generally comprises housing 50, which includes a peripheral sidewall 51, configured to be received on the sidewall 22 of the base 20. The housing 50 is provided with two depending hooks 53 and 54, which engage under the catch ledges 25 and 26 of the base. The housing is also provided with a depending resilient tab 55, which snaps into opening 24 in the base 22. Thus, the hooks 53, 54 and catch ledges 25, 26 act as hinge points, and the tab 55 releasably secures the housing in its closed position on base 20.

Spanning a portion of the peripheral sidewall 51 is a top panel 57, having the light bulb 85 mounted generally centrally therein. More particularly, an integral annular support 58 depends from the top panel 57 and generally within its opening is mounted a metal spring clip 60 for receiving the base 86 of the bulb 85. The spring clip 60 includes a terminal tab 61 which lies along the bottom of the annular support 58, as best seen in FIG. 4, and a screw may be secured or inserted through the terminal tab to mount the spring clip 60. The spring clip also has a vertically upstanding hook 62 best seen in FIG. 5, which hooks over the flange 87 of the bulb 85. Also mounted to the annular support 58 is a contact strip 63 for contacting the tip of bulb 85. The top panel 57 is provided with a planar reflector 65, which surrounds the mounted bulb 85.

The housing 50 further comprises front wall 70, which extends across the peripheral sidewall 51 at one end of the auxiliary lighting fixture. As best seen in FIG. 3, an opening 71 is defined between the front wall 70 and the front panel 57, and the upper edge of the opening is provided with a lip indicated at 72. The front wall 70 includes a switch panel 73, through which an "on" switch 101 and "off" switch 102 and a "timer" switch 103 protrude.

A circuit board 105 is mounted on the rear side of the housing 50, and the switches 101–103 form a part of the circuit and are mounted to the circuit board protruding through the switch panel 73. Silicone rubber switch covers are utilized at the openings to provide a sealed outer surface, and the silicone rubber switch covers are shown in the drawings over the actual switches 101–103. The circuit board contains the elements of circuit 100, described below with reference to the schematic circuit diagram of FIG. 7. However, with reference to FIG. 4, a wire 106 leads from the circuit board to the bulb mounting clip 60, and a wire 107 leads from the circuit board to the bulb tip contact spring 63. With continued reference to FIG. 4, contact strips 108 and 109 are mounted to the undersided circuit board. As best seen in FIG. 3, the contact strips 108 and 109 respectively contact the battery terminal strips 48 and 49 when the housing 50 is in position on the base, to thereby connect the circuit 100 to its battery power supply.

The auxiliary lighting fixture 20 lastly comprises a lens 90, which preferably has a front panel 91 and side panels coplanar with the peripheral sidewall 51 of the housing 50. The front panel 91 of the lens has a lip 92, which cooperates with the lip 72 of the housing to hold one end of the lens in position. The other end of the lens is held in position by integral spring hooks 93, which extend into cooperating openings in the housing. The lens is, of course, translucent, but is preferably not fully transparent. This provides both a good appearance and avoids any harsh lighting effects.

Figure 7:
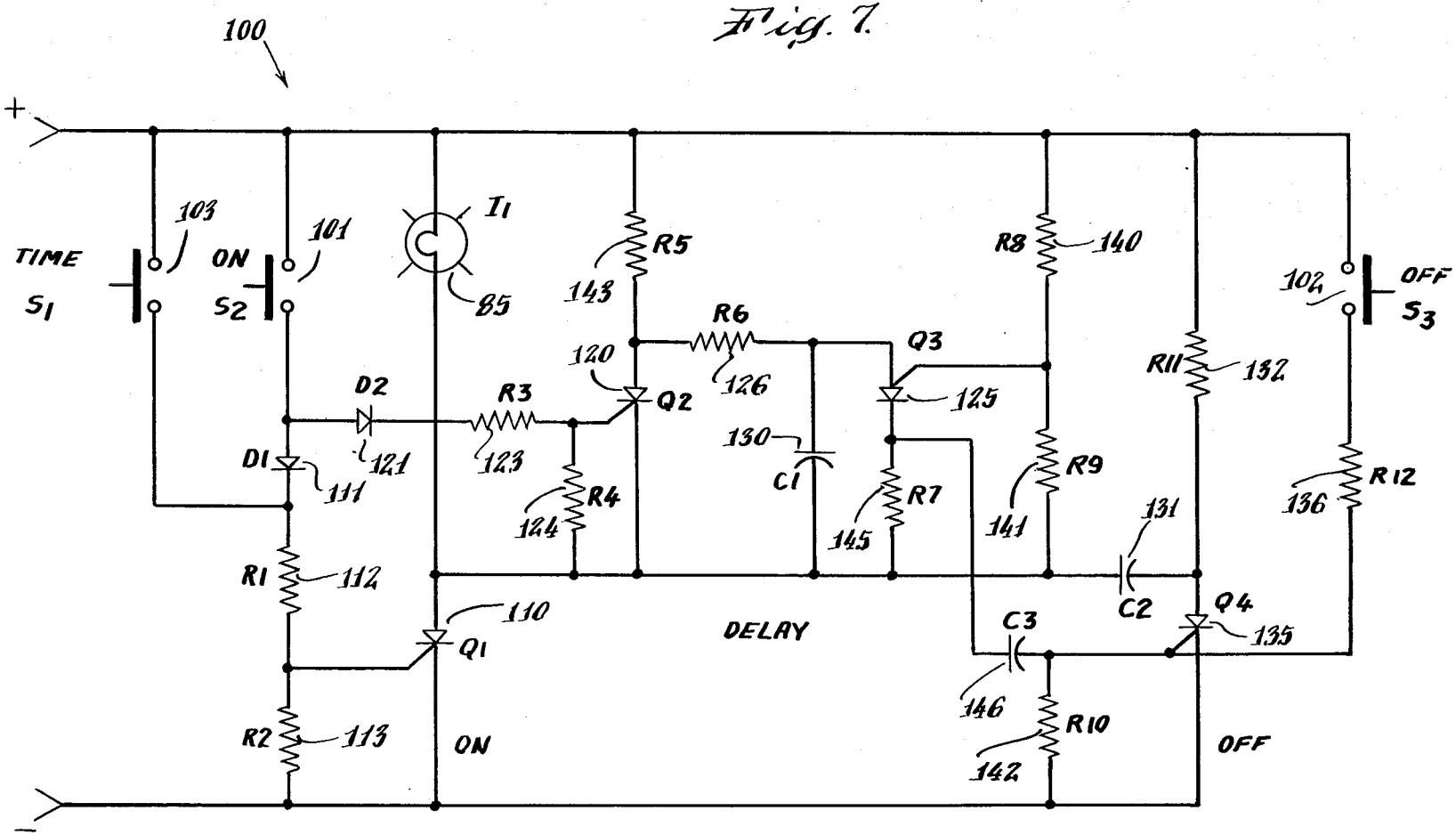
FIG. 7 is a schematic circuit diagram of the auxiliary lighting fixture of FIG. 1.

With reference to FIG. 7, there is shown a schematic diagram of a circuit 100 for the auxiliary lighting fixture 10. The circuit operates the light in either a manual "on/off" mode, under control of switches 101 and 102, or a timed "on" mode, under control of switch 103.

With respect to the manual "on/off" mode, when "on" switch 101 has been operated momentarily, the following occurs. Silicon controlled rectifier (SCR) 110 will be turned "on" by applying trigger current through diode 111 and resistor 112. This permits bulb 85 to be "on" also. Resistor 113 establishes sensitivity range for SCR 110 and provides gate current for SCR 110. Simultaneously, SCR 120 is turned "on" via diode 121 and resistor 123. Resistor 124 provides sensitivity for SCR 120. Thus, when SCR 110 turns "on", bulb 85 will be "on" and SCR 120 will be permitted to turn "on" also. When SCR 120 is "on", programmable unijunction transistor (PUT) 125 has power applied to it. However, the voltage drop on SCR 120 being 1 volt or less, the timing current required through resistor 126 and capacitor 130 will be clamped at voltage drop of SCR 120. Therefore, transistor 125 can never trigger by operation of the "on" switch 101.

In the meantime, capacitor 131 is charging toward power supply voltage via resistor 132. SCR 135 is "off" as the voltage drop across it is at full power supply voltage. Therefore, capacitor 131 is permitted to charge.

To turn bulb 85 "off", SCR 110 must be turned "off". This is accomplished by operating "off" switch 102 momentarily. Now, SCR 135 will be triggered via resistor 136. When SCR 135 is turned "on", it will dump the charge voltage on capacitor 131 to power supply negative. This creates a negative pulse on the anode of SCR 110. This dumping shunts away the anode current of SCR 110 and when the anode current has fallen below the holding current required for SCR 110, SCR 110 will turn "off". The foregoing explains the manual "off-on" operation of the auxiliary lighting fixture.

With respect to the timed mode of operation, when switch 103 has been operated momentarily, SCR 110 will be triggered "on" via resistor 112. Diode 111 prevents triggering of SCR 120. Now bulb 85 will be "on", SCR 120 is "off" and PUT 125 is permitted to function. Resistors 140 and 141 set the trigger level required for PUT 125 to fire. Capacitor 130 will be charging via resistors 143 and 126. When the charge voltage on capacitor 130 rises slightly above the trigger level set by resistors 140 and 141, PUT 125 will turn "on" and dumps the charge voltage from capacitor 130 onto resistor 145. Simultaneously, this dumped voltage pulses through capacitor 146 and turns SCR 135 "on". Prior to firing of PUT 125, capacitor 131 was charging toward the power supply voltage via resistor 132. When SCR 135 is turned "on", it will dump the charge voltage of capacitor 131 to the negative side of the power supply. This creates a negative pulse on the anode of SCR 110. This dumping shunts away the anode current of SCR 110, and when the anode current has fallen below the holding current required for SCR 110, SCR 110 will turn "off".

Thus, in the timed mode, bulb 85 will be "on" for the time period that capacitor 130 charges and until PUT 125 fires. The timer can be turned "off" also by operating switch 102 momentarily which turns "on" SCR 135 via resistor 136, whereby the turn-off process described above will take place. Time range is 30 seconds with component value shown.

Component values and identification for the circuit of FIG. 7 are as follows:

| | |
|---|---|
| Diodes 111,121 | Diode 1N4848; |
| Capacitors 130, 131 | 10 uf, 16 volt; |
| Capacitor 146 | 1 uf, 16 volt; |
| Resistors 112, 123, 124, 145, 136 | 150 ohm, ¼ watt; |
| Resistor 113 | 82 ohm, ¼ watt; |
| Resistor 143 | 4.3 Kohm, ¼ watt; |
| Resistor 126 | 630–800 Kohm, ¼ watt; |
| Resistor 140 | 18 Kohm, ¼ watt; |
| Resistor 141 | 47 Kohm, ¼ watt; |
| Resistor 142 | 1 Kohm, ¼ watt; |
| Resistor 132 | 100 Kohm, ¼ watt; |
| SCRs 110, 120, 135 | SCR C103Y; and |
| PUT 125 | PUT 2N6027. |

The auxiliary lighting fixture described above admirably achieves the objects of the invention herein. It will be appreciated that various changes may be made in the preferred embodiment without departing from the spirit and scope of the invention herein, which is limited only by the following claims.

We claim:

1. An auxiliary lighting fixture comprising:

(A) a base adapted for being hung on a vertical wall and having at least one battery received therein, and further having a first pair of conductive strips respectively contacting the battery terminals and electrically presenting the battery terminals;

(B) a housing releasably secured on the base, the housing mounting a light bulb and a translucent lens positioned over the light bulb; and (C) switch means mounted on the housing and electrically conductive means for completing a circuit including the battery, light bulb and switch means, the electrically conductive means including a second pair of conductive strips positioned on the housing to each respectively contact one of the first pair of conductive strips when the housing is secured on the base, thereby connecting the battery into the circuit.

2. An auxiliary lighting fixture as defined in claim 1 wherein the housing and base are generally rectangular, the housing having two hooks which respectively engage under two ledges of the base along one side of the rectangle, and the housing has a resilient depending tab received in an opening along the opposite side of the rectangle to releasably secure the housing and base together.

3. An auxiliary lighting fixture as defined in claim 2 wherein the translucent lens is removably snap-fitted onto the housing.

4. An auxliary lighting fixture as defined in claim 3 wherein the light bulb is of the type having a generally cylindrical nonthreaded base with an out-turned flange at the upper end thereof and a glass envelope mounted to the base, and housing mounts the light bulb by means of a metal clip having two arms gripping the base and a hook engaged over the flange, and an electrically separate bulb tip contact.

5. An auxiliary lighting fixture as defined in claim 4 wherein the light bulb is surrounded by a planar reflector positioned under the translucent lens.

6. An auxiliary lighting fixture as defined in claim 5 wherein the circuit includes a timer, the switch means includes means for starting the timer and turning on the light bulb, and the circuit further includes means for turning off the light bulb after an interval timed by the timer.

7. An auxiliary lighting fixture as defined in claim 6 wherein the switch means includes an ON switch for turning on the light bulb (but not starting the timer), an OFF switch for turning off the light, and a timer switch to start operation of the timer.

8. An auxiliary lighting fixture as defined in claim 7 wherein operation of the OFF switch turns off the light during operation of the timer.

9. An auxiliary lighting fixture as defined in claim 8 wherein the timer interval is in the range of 30 to 45 seconds.

10. An auxiliary lighting fixture as defined in claim 1 wherein the translucent lens is removably snap-fitted onto the housing.

11. An auxiliary lighting fixture as defined in claim 1 wherein the light bulb is of the type having a generally cylindrical nonthreaded base with an out-turned flange at the upper end thereof and a glass envelope mounted to the base, and housing mounts the light bulb by means of a metal clip having two arms gripping the base and a hook engaged over the flange, and an electrically separate light bulb tip contact.

12. An auxiliary lighting fixture as defined in claim 1 wherein the light bulb is surrounded by a planar reflector positioned under the translucent lens.

13. An auxiliary lighting fixture as defined in claim 1 wherein the circuit includes a timer, the switch means includes means for starting the timer and turning on the light bulb, and the circuit further includes means for turning off the light bulb after an interval timed by the timer.

14. An auxiliary lighting fixture as defined in claim 1 wherein the switch means includes an ON switch for turning on the light bulb (but not starting the timer), an OFF switch for turning off the light bulb, and a timer switch to start operation of the timer, and operation of the OFF switch turns off the light bulb during operation of the timer.

15. An auxiliry lighting fixture as defined in claim 1 wherein the base is adapted for being hung on a vertical wall by having a first piece of a two-piece statistical loop fastener secured thereto, whereby a second piece of the statistical loop fastener may be secured to a vertical wall for engaging with the first piece.

16. An auxiliary lighting fixture as defined in claim 15 wherein the base defines a keyhole slot adapting the base to be hung on a nail or other headed projection.

17. An auxiliary lighting fixture comprising:

(A) a base, housing and lens removably assembled together into a unit adapted for being hung on a vetical wall, said unit enclosing and holding a battery power supply and mounting a light bulb under the lens; and (B) a circuit connecting the battery power supply and the light bulb, said circuit including a timer portion and a timer switch operable to turn on the light bulb and activate the timer portion, and means automatically turning off the light bulb after the timer portion of the circuit has timed a preset interval, and (C) said circuit further comprising an ON switch operable to turn on the light bulb for an untimed interval, and an OFF switch operable to turn off light bulb.

18. An auxiliary lighting fixture as defined in claim 17 wherein operation of the OFF switch turns off the light bulb prior to expiration of a timed interval initiated by operating the timer switch.

19. An auxiliary lighting fixture as defined in claim 17 wherein the preset interval is in the range of 30 to 45 seconds.

* * * * *